United States Patent [19]

Gump et al.

[11] 4,004,053

[45] * Jan. 18, 1977

[54] STABILIZATION OF ACRYLIC FIBERS AND FILMS

[75] Inventors: Klaus Hannes Gump, Gillette; Dagobert Engelbert Stuetz, Westfield, both of N.J.

[73] Assignee: Celanese Corporation, New York, N.Y.

[ * ] Notice: The portion of the term of this patent subsequent to Dec. 2, 1992, has been disclaimed.

[22] Filed: Nov. 18, 1971

[21] Appl. No.: 200,183

[52] U.S. Cl. ..... 427/379; 106/15 FP; 427/430 R; 428/394; 428/921

[51] Int. Cl.[2] ..... B05D 3/02

[58] Field of Search ..... 117/138.8 UD, 136; 260/45.85 S, 45.9 R, 45.7 R, 45.7 S, 45.95; 106/15 FP; 264/782; 427/379, 381, 430 R; 428/921, 394, 500; 8/115.5

[56] References Cited

UNITED STATES PATENTS

| | | | |
|---|---|---|---|
| 2,931,694 | 4/1960 | Wirth et al. | 117/138.8 X |
| 3,546,163 | 12/1970 | Peterli | 260/45.85 |
| 3,637,809 | 1/1972 | Kleiner | 260/45.85 |
| 3,677,942 | 7/1972 | Feiner et al. | 260/45.75 |
| 3,708,326 | 1/1973 | Chenevey et al. | 117/138.8 |
| 3,923,950 | 12/1975 | Gump et al. | 264/182 |

*Primary Examiner*—Harry J. Gwinnell
*Assistant Examiner*—Sadie L. Childs

[57] ABSTRACT

An improved process for the thermal stabilization of an acrylic fibrous material or film is provided. The fibrous precursor or film is impregnated with an organic antioxidant by contact with a solution of the same provided at a moderate temperature, dried to remove the solvent, and heated in an oxygen-containing atmosphere at a more highly elevated temperature until a stabilized fibrous material or film is formed. The organic antioxidant advantageously serves to moderate the oxidative portion of the stabilization reaction and enables the cyclization portion thereof to proceed in the absence of substantial polymer chain degradation. The resulting stabilized fibrous material or film is flexible and nonburning, and may be utilized as a fire resistant fiber, fabric or film, or optionally carbonized or carbonized and graphitized to form a carbonaceous fibrous material or film.

28 Claims, No Drawings

STABILIZATION OF ACRYLIC FIBERS AND FILMS

BACKGROUND OF THE INVENTION

In the past procedures have been proposed for the conversion of fibers formed from acrylic polymers to a modified form possesing enhanced thermal stability. Such modification has generally been accomplished by heating a fibrous material in an oxygen-containing atmosphere at a moderate temperature for an extended period of time.

U.S. Pat. Nos. 2,913,802 to Barnett and 3,285,696 to Tsunoda disclose processes for the conversion possessing fibers of acrylonitrile homopolymers or copolymers to a heat resistant form. The stabilization of shaped articles of acrylonitrile homopolymers and copolymers in an oxygen-containing atmosphere involves (1) a chain scission and oxidative cross-linking reaction of adjoining molecules, as well as (2) a cyclization reaction of pendant nitrile groups. It is generally recognized that the rate at which the stabilization reaction takes place increases with the temperature of the oxygen-containing atmosphere. However, in the past the stabilization reaction must by necessity at least initially be conducted at relatively low temperatures (i.e. below about 300° C.), since the cyclization reaction is known to be exothermic in nature and must be controlled if the original configuration of the material undergoing stabilization is to be preserved. Accordingly, the stabilization reaction has tended to be time consuming, and economically demanding because of low productivity necessitated by the excessive time requirements. Prior processes proposed to shorten the period required by the stabilization reaction include that disclosed in U.S. Pat. No. 3,416,874. See also the process of our commonly assigned U.S. Pat. No. 3,592,595, wherein the cyclization of pendant nitrile groups of the acrylic fibrous material is catalytically enhanced while the fibrous material is immersed in a solution of a Lewis acid at a temperature of about 160° to 260° C.

While stabilized acrylic fibrous materials may be used directly in applications where a non-burning fiber is required, demands for the same have been increasingly presented by manufacturers of carbonized fibrous materials. Carbonized fibrous materials are commonly formed by heating a stabilized acrylic fibrous material in an inert atmosphere, such as nitrogen or argon, at a more highly elevated temperature. During the carbonization reaction elements such as nitrogen, oxygen, and hydrogen are substantially expelled. Accordingly, the term "carbonized" as used in the art commonly designates a material consisting of at least about 90 percent carbon by weight, and generally at least about 95 percent carbon by weight. Depending upon the conditions under which a carbonized fibrous material is processed, it may or may not contain graphitic carbon as determined by the characteristic x-ray diffraction pattern of graphite. See, for instance, commonly assigned U.S. Ser. No. 777,275, filed Nov. 20, 1968 (now abandoned) of Charles M. Clarke for a preferred procedure for forming continuous lengths of carbonized and graphitized fibrous materials from a stabilized acrylic fibrous materials.

It is an object of the invention to provide an improved process for enhancing the thermal stability of a shaped acrylic article.

It is an object of the invention to provide an improved process for the flame-proofing of a fibrous material or film formed from an acrylic polymer to produce a dimensionally stable flexible product.

It is an object of the invention to provide a process for the thermal stabilization of an acrylic fibrous material or film wherein degradation and chain scission within the acrylic precursor is substantially diminished.

It is an object of the invention to provide a process wherein the thermal stabilization of an acrylic fibrous material or film optionally may be conducted for a brief residence time at a more highly elevated temperature than heretofore commonly utilized.

It is another object of the invention to provide an improved process for the stabilization of fibrous materials or films formed from acrylic polymers which results in a product which is suitable for carbonization, or carbonization and graphitization.

It is further object of the invention to provide a process for converting an acrylic fibrous material or film to a stabilized form possessing substantially the identical configuration as the starting material.

These and other objects, as well as the scope, nature, and utilization of the invention will be apparent from the following detailed description and appended claims.

SUMMARY OF THE INVENTION

It has been found that an improved process for the stabilization of an acrylic fibrous material or film selected from the group consisting of an acrylonitrile homopolymer and acrylonitrile copolymers containing at least about 85 mol percent of acrylonitrile units and up to about 15 mol percent of one or more monovinyl units copolymerized therewith comprises:

a. impregnating the fibrous material or film with a minor quantity of a organic antioxidant capable of moderating the oxidative cross-linking reaction of adjoining acrylic molecules by contact with a solution of the organic antioxidant in a solvent incapable of dissolving the fibrous material or film having a temperature of about 0° to 100° C. while preserving the original configuration of the fibrous material or film substantially intact, b. drying the fibrous material or film to substantially remove the solvent therefrom, and c. heating the resulting impregnated and dried fibrous material or film in an oxygen-containing atmosphere at a temperature of about 200° to 360° C. until a stabilized fibrous material or film is formed which retains its original configuration substantially intact and which is non-burning when subjected to an ordinary match flame.

DESCRIPTION OF PREFERRED EMBODIMENTS

The acrylic shaped articles, i.e. fibers or films, undergoing stabilization in the present process may be formed by conventional solution spinning techniques (i.e. may be dry spun or wet spun) or by conventional solvent casting techniques, and are commonly drawn to increase their orientation. As is known in the art, dry spinning is commonly conducted by dissolving the polymer in an appropriate solvent, such as N,N-dimethylformamide or N,N-dimethylacetamide, and passing the solution through an opening of predetermined shape into an evaporative atmosphere (e.g. nitrogen) in which much of the solvent is evaporated. Wet spinning is commonly conducted by passing a solution of the polymer through an opening of predetermined shape into a coagulation bath. Casting is commonly conducted by placing a solution containing the polymer upon a support, and evaporating the solvent therefrom.

The acrylic polymer utilized as the starting material is formed primarily of recurring acrylonitrile units. For instance, the acrylic polymer should generally contain not less than about 85 mol percent of acrylonitrile units and not more than about 15 mol percent of units derived from a monovinyl compound which is copolymerizable with acrylonitrile such as styrene, methyl acrylate, methyl methacrylate, vinyl acetate, vinyl chloride, vinylidene chloride, vinyl pyridine, and the like, or a plurality of such monomers. The pendant nitrile groups present within the acrylic shaped article (i.e. fiber or film) are substantially uncyclized.

The preferred acrylic precursor is an acrylonitrile homopolymer. Preferred acrylonitrile copolymers contain at least about 95 mol percent of acrylonitrile units and up to about 5 mol percent of one or more monovinyl units copolymerized therewith.

The acrylic precursor is preferably provided as a continuous length of fibrous material and may be in a variety of physical configurations. For instance, the acrylic fibrous materials may be present in the form of continuous lengths of multifilament yarns, tows, tapes, strands, cables, or similar fibrous assemblages. Alternatively, acrylic films of relatively thin thickness, e.g. about 1 to 10 mils, may be selected as the precursor.

When the starting material is a continuous multifilament yarn, a twist may be imparted to the same to improve the handling characteristics. For instance, a twist of about 0.1 to 5 tpi, and preferably about 0.3 to 1.0 tpi may be utilized. Also a false twist may be used instead of or in addition to a real twist. Alternatively, one may select bundles of fibrous material which possess substantially no twist.

The starting material may be drawn in accordance with conventional techniques in order to improve its orientation. For instance, the starting material may be drawn by stretching while in contact with a hot shoe at a temperature of about 140° to 160° C. Additional representative drawing techniques are disclosed in U.S. Pat. Nos. 2,455,173; 2,948,581; and 3,122,412. It is recommended that the acrylic fibrous materials selected for use in the process be drawn to a single filament tenacity of at least about 3 grams per denier. If desired, however, the starting material may be more highly oriented, e.g. drawn up to a single filament tenacity of about 7.5 to 8 grams per denier, or more. Acrylic films optionally may be either uniaxially or biaxially oriented.

Prior to heating the acrylic fibrous material or film in an oxygen-containing atmosphere to accomplish the desired stabilization (as described hereafter), the precursor is impregnated with a minor quantity of an organic antioxidant capable of moderating or inhibiting the oxidative cross-linking reaction of adjoining acrylic molecules, e.g. when heated in an oxygen-containing atmosphere at 200° C., or above. The organic antioxidant optionally may be nitrogen-free phenolic antioxidant, an aminophenol antioxidant, a non-phenolic aromatic amine antioxidant, a quinone antioxidant, a sulfur-containing antioxidant, or mixtures of the foregoing. The organic antioxidants selected preferably have a melting point of at least 200° C.

The nitrogen-free phenolic antioxidants selected for use in the process may be either sterically hindered phenols or non-sterically hindered bisphenols. The phenols are considered to be sterically hindered for the purposes of the present description if at least one of the ring positions adjoining (i.e. ortho to) a hydroxyl group is occupied by a substituent other than hydrogen, e.g. a halogen, an alkyl group, a methoxy group, etc. Also, the steric hindrance may be provided by an adjoining fused ring, such as in 1,5-naphthalenediol. Representative nitrogen-free phenolic antioxidants suitable for use in the process include:

tetrachlorohydroquinone, [$C_6H_2Cl_4O_2$];
tetrabromohydroquinone, [$C_6H_2Br_4O_2$];
tetraiodohydroquinone, [$C_6H_2I_4O_2$];
tetrachlorobisphenol A, [$C_{15}H_{12}Cl_4O_2$];
tetrabromobisphenol A, [$C_{15}H_{12}Br_4O_2$];
tetraiodobisphenol A, [$C_{15}H_{12}I_4O_2$];
dichlorobisphenol A, [$C_{15}H_{14}Cl_2O_2$];
dibromobisphenol A, [$C_{15}H_{14}Br_2O_2$];
diiodobisphenol A, [$C_{15}H_{14}I_2O_2$];
2,6-dichlorophenol, [$C_6H_4Cl_2O$];
2,6-dibromo-4-tert-butylphenol, [$C_{10}H_{12}Br_2O$];
2,6-dibromo-1,5-naphthalenediol, [$C_{10}H_6Br_2O_2$];
2,6-di-tert-butyl-p-cresol, [$C_{15}H_{24}O$];
2,6-di-tert-butylphenol, [$C_{14}H_{22}O$];
1,5-naphthalenediol, [$C_{10}H_8O_2$];
2,6-di-tert-butyl-4-methylphenol, [$C_{15}H_{24}O$];
2,4-dimethyl-6-tert-butylphenol, [$C_{11}H_{18}O$];
2,5-di-tert-amyl hydroquinone, [$C_{16}H_{26}O_2$];
2,4-di-tert-amylphenol, [$C_{16}H_{26}O$];
4,4'-butylidenebis(6-tert-butyl-m-cresol), [$C_{26}H_{38}O_2$];
p,p'-bisphenol, [$C_{12}H_{10}O_2$]; and
bisphenol A, [$C_{15}H_{16}O_2$].

Alkali or alkaline earth metal salts of the nitrogen-free phenolic antioxidants may also be selected for use in the process.

Representative aminophenol antioxidants suitable for use in the process include:

2,4,6-triaminophenol, [$C_6H_9N_3O$];
2-aminophenol, [$C_6H_7NO$];
2-amino-4-nitrophenol, [$C_6H_6N_2O_3$];
N-lauroyl-p-aminophenol, [$C_{18}H_{29}NO_2$];
N-phenyl-p-aminophenol, [$C_{12}H_{12}NO$];
N-tert-butyl-p-aminophenol, [$C_{10}H_{15}NO$];
N-isopropyl-p-aminophenol, [$C_9H_{13}NO$]; and
N-cyclohexyl-p-aminophenol, [$C_{12}H_{16}NO$].

Alkali or alkaline earth metal salts of the aminophenol antioxidants may also be selected for use in the process.

The non-phenolic aromatic amine antioxidants for use in the process may be either a polyarylamine or a alkylarylamine. Representative non-phenolic aromatic amine antioxidants for use in the process include:

N-phenyl-1-naphthylamine, [$C_{16}H_{13}N$];
N-phenyl-2-naphthylamine, [$C_{16}H_{13}N$];
N,N'-di-sec-butyl-para-phenylenediamine, [$C_{14}H_{24}N_2$];
4,4'-dioctyl-diphenylamine, [$C_{28}H_{43}N$];
N,N'-di-isopropyl-para-phenylenediamine, [$C_{12}H_{20}N_2$];
diphenylamine, [$C_{12}H_{11}N$];
N-cyclohexylphenylamine, [$C_{12}H_{16}N$];
4,4'-dimethoxydiphenylamine, [$C_{14}H_{15}NO_2$];
N-tert-butylphenylamine, [$C_{10}H_{15}N$];
N-isopropylphenylamine, [$C_9H_{13}N$];
p-isopropoxydiphenylamine, [$C_{18}H_{23}NO_2$];
N,N'-diphenyl-p-phenylenediamine, [$C_{18}H_{16}N_2$];
N,N',di-2-naphthyl-p-phenylenediamine, [$C_{26}H_{20}N_2$];
dihydroquinoline, [$C_9H_9N$];
1,2-dihydro-2,2,4-trimethyl-6-dodecylquinoline, [$C_{24}H_{29}N$]; and 1,2-dihydro-2,2,4-trimethyl-6-phenylquinoline, [$C_{18}H_{18}N$].

The non-phenolic aromatic amine antioxidants may additionally be selected from among the Schiff bases which are the reaction or condensation products of an aldehyde or ketone with an aromatic amine. For instance, commercially available antioxidants formed by the condensation of diphenylamine and acetone, or diphenylamine, acetone, and a formadehyde resin, may be selected. Such condensation products are available under the designations of BLE-25, AgeRite Superflex, Aminox, and BXA antioxidants.

The quinone antioxidants selected for use in the process possess a pair of carbonyl groups positioned upon a ring which lacks the conjugate structure characteristic of aromatic compounds. The other ring positions of the quinone may be substituted, i.e. be provided with at least one hydroxyl group, amine group, nitro group, alkyl group, etc., or fused to at least one aromatic ring. When a hydroxy quinone is selected it may optionally be provided in the form of its alkali or alkaline earth metal salt. Representative quinone antioxidants suitable for use in the process include:

chloranil, [$C_6Cl_4O_2$];
chloranilic acid, [$C_6H_2Cl_2O_4$];
1,4-naphthoquinone, [$C_{10}H_6O_2$];
2,6-dichloro-p-benzoquinone, [$C_6H_2Cl_2O_2$];
2-chloroanthroquinone, [$C_{14}H_7ClO_2$];
2,3-dichloro-1,4-naphthoquinone, [$C_{10}H_4Cl_2O_2$];
o-benzoquinone, [$C_6H_4O_2$];
2,6-dimethyl-p-benzoquinone, [$C_8H_8O_2$];
2,3,5,6-tetramethyl-p-benzoquinone, [$C_{10}H_{10}O_2$];
1,4naphthoquinone, [$C_{10}H_6O_2$];
1-nitroanthroquinone, [$C_{14}H_7NO_4$];
1-aminoanthroquinone, [$C_{14}H_9NO_2$];
2-aminoanthroquinone, [$C_{14}H_9NO_2$];
4,5-dichloro-1-nitroanthroquinone, [$C_{14}H_5Cl_2NO_4$];
1,2-dihydroxyanthroquinone, [$C_{14}H_8O_2$]; and
phenanthrenequinone, [$C_{14}H_8O_2$].

The sulfur-containing antioxidants selected for use in the process optionally may be thiazyl derivatives, dithiocarbamates, or condensation products of thiourea. Representative sulfur-containing antioxidants for use in the process include:

2-mercaptobenzothiazole, [$C_7H_5NS_2$];
beta, beta'-dithiodipropionic acid, [$C_6H_{10}O_4S_2$];
3,3'-thiodipropionic acid, [$C_6H_{10}O_4S$];
bis(dimethylthiocarbamoyl)disulfide, [$C_6H_{12}N_2S_4$];
tetramethylthiuramdisulfide, [$C_6H_{12}N_2S_4$];
1,1'-thiodi-2-naphthol, [$C_{20}H_{18}O_2S$];
1,1'-thiobis(N-phenyl-2-naphtholamine), [$C_{20}H_{18}N_2O_2S$]; and
bis(N-phenyl-2-naphtholamine)sulfide, [$C_{20}H_{18}N_2O_2S_2$].

The sulfur-containing antioxidants may alternatively be provided as alkali or alkaline earth metal salts.

The particularly preferred organic antioxidant for use in the process is tetrachlorohydroquinone, chloranil, or chloranilic acid. The bromo- and iodo- homologs of tetrachlorohydroquinone are also preferred, as are the di- and tetra-halogenated (i.e. chloro-, bromo-, and iodo-) forms of bisphenol A.

The nature of the solvent utilized to form the solution of the organic antioxidant which is contacted with the acrylic precursor during the impregnation step of the process may be varied widely. It is essential that the solvent have the ability to dissolve the organic antioxidant while being incapable of dissolving or otherwise adversely influencing the acrylic material undergoing treatment. Representative solvents for the organic antioxidant include methanol, acetonitrile, methylene chloride, water, dioxane, ethanol, isopropanol, acetone, methyethylketone, ethylacetate, etc., and mixed solvents such as mixtures of water with N,N-dimethylformamide, N,N-dimethylacetamide, dimethylsulfoxide, and N-methyl-2-pyrrolidone, etc. For instance, a water/N,N-dimethylformamide solvent mixture may be utilized consisting of about 60 parts by volume water and 40 parts by volume N,N-dimethylformamide. Those solvents which have the ability to swell the acrylic precursor during the impregnation step are preferred so that the organic antioxidant is able to diffuse substantially throughout the fiber or film.

The concentration of the organic antioxidant in the solution of the same used during the impregnation step is commonly about 0.2 to 20 percent by weight based upon the total weight of the solution, and preferably about 1 to 10 percent by weight based upon the total weight of the solution.

The impregnation step of the process may be conducted on either a batch or a continuous basis. For instance, a continuous length of the acrylic precursor may be wound upon a mandrel or other support and immersed in the solution containing the organic antioxidant, or continuously passed through the same, e.g. in the direction of its length while guided by rollers or other guide means. Contact between the acrylic material and the solution may alternatively be made by spraying or other padding technique as will be apparent to those skilled in the art. During impregnation the solution is provided at a moderate temperature of about 0° to 100° C., and preferably at a temperature of about 10° to 40° C. Higher temperatures are to be avoided in order to diminish the possibility of the premature chemical modification (e.g. cyclization) of the acrylic fibrous material at this point in the process. Accordingly a minor quantity (discussed hereafter) of the organic antioxidant is able to substantially impregnate and diffuse into the interior of the precursor fiber or film without the retardation of diffusion resulting from the cyclization of pendant nitrile groups at the surface. Also, more highly elevated temperatures tend to promote excessive shrinkage. Contact times commonly range from 30 seconds to 10 minutes, depending primarily upon the concentration of the organic antioxidant in the solution, and the relative freedom of access of the solution throughout the acrylic material undergoing impregnation. For instance, if a fibrous material is provided as a relatively compact assemblage, longer contact times are required.

Following impregnation the acrylic fibrous material or film is next dried so that the solvent is substantially removed, and a minor quantity of the organic antioxidant provided in intimate association therewith. The drying step may be conducted in any convenient manner commonly at a temperature of about 10° to 100° C. The impregnated acrylic precursor may be simply exposed to ambient conditions until solvent adhering thereto is substantially evaporated. For instance, drying may be conducted by exposure to a gaseous atmosphere at a temperature of about 10° to 40° C. The drying step can, of course, be expedited by exposure to a circulating gaseous atmosphere at a more highly elevated temperature, e.g. 80° to 100° C., or even in the same zone where the stabilization reaction is carried out (as described hereafter). It is recommended, however, that drying be conducted at a moderate temperature not exceeding about 100° C. because of the possibility of adversely influencing the tensile properties of the acrylic material during the vigorous evolution of solvent at a more highly elevated temperature. The resulting impregnated and dried acrylic material contains about 1 to 10 percent by weight of the organic antioxidant, and preferably about 5 to 10 percent by weight of the organic antioxidant.

The resulting impregnated and dried acrylic material is heated to an oxygen-containing atmosphere at a temperature of about 200 to about 360° C. until a stabilized fibrous product or film is formed which retains its original configuration substantially intact and which is non-burning when subjected to an ordinary match flame. In a preferred embodiment of the process the oxygen-containing atmosphere is air. Preferred temperatures for the oxygen-containing atmosphere range from about 240° to 360° C., and most preferably about 270° to 315° C. If desired, the fibrous material or film may be exposed to a temperature gradient wherein the temperature is progressively increased.

For best results, uniform contact during the stabilization reaction with molecular oxygen throughout all portions of the impregnated acrylic material is encouraged. Such uniform reaction conditions can best be accomplished by limiting the mass of fibrous material or film at any one location so that heat dissipation from within the interior of the same is not unduly impaired, and free access to molecular oxygen is provided. For instance, the acrylic fibrous material or film may be placed in the oxygen-containing atmosphere while wound upon a support to a limited thickness. In a preferred embodiment of the invention, the impregnated acrylic fibrous material or film is continuously passed in the direction of its length through the heated oxygen-containing atmosphere. For instance, a continuous length of the acrylic fibrous material or film may be passed through a circulating oven or the tube of a muffle furnace. The speed of passage through the heated oxygen-containing atmosphere will be determined by the size of the heating zone and the desired residence time.

The period of time required to complete the stabilization reaction within the oxygen-containing atmosphere is generally inversely related to the temperature of the atmosphere, and is also influenced by the denier of the acrylic fibrous material or the thickness of the film undergoing treatment, and the concentration of molecular oxygen in the atmosphere. Treatment times in the oxygen-containing atmosphere accordingly commonly range from about 5 to 600 minutes. For instance, representative residence times at specific temperatures are as follows:

| Temperature | Residence Time |
|---|---|
| 200° C. | 600 minutes |
| 250° C. | 180 minutes |
| 360° C. | 5 minutes |

Regardless of the stabilization temperature selected within the range of about 200° to 360° C., the presence of the acrylic fibrous material or film in impregnated form while in intimate association with the organic antioxidant results in an accelerated cyclization portion of the stabilization reaction at a given temperature.

The stabilized acrylic fibrous materials or films formed in accordance with the present process are black in appearance, dimensionally stable, flexible, retain essentially the same configuration as the starting material, are non-burning when subjected to an ordinary match flame, commonly have a bound oxygen content of at least 7 (e.g. 7 to 12) percent by weight as determined by the Unterzaucher or other suitable analysis, and commonly contain from about 50 to 65 percent carbon by weight.

The theory whereby the organic antioxidants herein discussed serve to beneficially influence the stabilization reaction is considered complex and incapable of simple explanation. It is believed, however, that these compounds serve at least partially to moderate or to inhibit the destructive oxidative protion of the stabilization reaction which concomitantly tends to diminish polymer degradation and polymer chain scission. The cyclization portion of the reaction is accordingly permitted advantageously to proceed with reduced competition from the oxidative portion of the stabilization reaction. The presence of the organic antioxidant surprisingly enables the stabilization reaction to be successfully conducted at temperatures as high as 360° C. The ability for one to carry out the stabilization reaction at such a highly elevated temperature without sacrifice in product properties enables the overall stabilization reaction to be accelerated thereby increasing the overall efficiency of the reaction and rate of production.

When a shaped acrylic article, e.g. an acrylonitrile homopolymer fiber or film, which has not undergone any previous thermal stabilization, is placed in an oxygen-containing atmosphere at a temperature of about 300° C. or above, the shaped article immediately shrinks approximately 50 percent of its original length and finally crumbles thereby destroying its original configuration. If the shaped article is removed prior to such crumbling it will be extremely brittle and of little utility. Alternatively, if the shaped acrylic article has been previously impregnated with 1 to 10 percent by weight of an organic antioxidant as previously described (e.g. with tetrachlorohydroquinone), upon undergoing an identical thermal treatment it is converted to a shiny black stabilized form with a retention of its original geometry and flexibility.

When a shaped acrylic article, e.g. an acrylonitrile homopolymer fiber or film, which has not undergone any previous thermal stabilization is heated in an oxygen-containing atmosphere from room temperature (i.e. 25° C.) at a rate of 20° C./minute, a 30 to 40 percent weight loss is observed when a temperature of about 300° C. is reached. This weight loss is accompanied by a spontaneous exotherm which is attributed to the cyclization of pendant nitrile groups and a simultaneous chain scission reaction with the evolution of low molecular weight products, e.g. $NH_3$, HCN, $CH_3CN$, etc. Alternatively, if the shaped acrylic article has been previously impregnated with 1 to 10 percent of an organic antioxidant (e.g. with tetrachlorohydroquinone), upon undergoing an identical thermal treatment no explosive exotherm and no weight loss is observed when heating up to 425° C. Accordingly, the process of the present invention makes possible a lower weight loss during the stabilization reaction. The resulting stabilized products if subsequently converted to carbon fibers or films likewise produce a higher eventual carbon yield.

The stabilized fibrous material resulting from the stabilization treatment of the present invention is suitable for use in applications where a fire resistant fibrous material is required. For instance, nonburning fabrics may be formed from the same. As previously indicated, the stabilized acrylic fibrous materials are particularly suited for use as intermediates in the production of carbonized fibrous materials. Such amorphous carbon or graphitic carbon fibrous products may be incorporated in a binder or matrix and serve as a reinforcing medium. The carbon fibers may accordingly serve as a lightweight load bearing component in high performance composite structures which find particular utility in the aerospace industry.

The stabilized film resulting from the stabilization treatment is suitable for use in applications where a fire resistant sheet material is required. Such stabilized films may also be utilized as intermediates in the production of carbonized films. Such carbonized films may be utilized in the formation of lightweight high temperature resistant laminates when incorporated in a matrix material (e.g. an epoxy resin).

The following examples are given as specific illustrations of the invention. It should be understood, however, that the invention is not limited to the specific details set forth in the examples.

EXAMPLE I

A continuous length of an 800 fil dry spun acrylonitrile homopolymer continuous filament yarn having a total denier of 1200 is selected as the starting material. The yarn is initially dry spun from a solution of the same in N,N-dimethylformamide solvent into an evaporative atmosphere of nitrogen. The yarn is spun as a 40 fil bundle, and plied to form the 800 fil yarn which exhibits a twist of about 0.5 tpi. The yarn is next drawn at a draw ratio of about 5:1 to a single filament tenacity of about 4 grams per denier by stretching while passing over a hot shoe at a temperature of about 160° C. for a residence time of about 0.5 second.

A solution of tetrachlorohydroquinone is formed by dissolving the same in methyl alcohol at room temperature (i.e. 25° C.). Tetrachlorohydroquinone is present in the solution in a concentration 10 percent by weight. The acrylonitrile homopolymer yarn is immersed in the solution which is provided at 25° C. by continuous passage through a vessel containing the solution for a total residence time of 10 minutes. While present in the solution, the yarn becomes impregnated with tetrachlorohydroquinone.

The yarn is next removed from the solution and is dried at a temperature of 90° C. by placement in a circulating air oven so that the methyl alcohol solvent adhering to the same is substantially evolved. The resulting impregnated and dried yarn contains tetrachlorohydroquinone in a concentration of about 6 percent by weight.

The yarn is next stabilized on a continuous basis by passage for 7 minutes through a tube furnace provided with a circulating heated air atmosphere having a maximum temperature of 340° C. while axially suspended therein.

The resulting stabilized yarn is shiny black in appearance, flexible, has a textile-like hand, retains its original fibrous configuration substantially intact, is non-burning when subjected to any ordinary match flame, retains strength after glowing in a match flame, and has an oxygen content of about 7.5 percent by weight as determined by the Unterzaucher analysis.

In a control run, an identical sample of the acrylonitrile homopolymer yarn is passed through the tube furnace in an identical manner with the exception that it had not been previously impregnated with tetrachlorohydroquinone. The control yarn is incapable of withstanding the 340° C. stabilization temperature and breaks.

The resulting stabilized yarn of Example I is carbonized and graphitized in accordance with the teachings of U.S. Ser. No. 777,275, filed Nov. 20, 1968 (now abandoned), of Charles M. Clarke, which are herein incorporated by reference. The graphite yarn exhibits satisfactory tensile properties.

EXAMPLE II

Example I is repeated with the exception that the yarn is immersed in a solution of chloranil dissolved in acetonitrile. The chloranil is present in the solution in a concentration of 5 percent by weight based upon the total weight of the solution.

Substantially similar results are achieved.

EXAMPLE III

Example I is repeated with the exception that the yarn is immersed in a solution of chloranilic acid dissolved in water. The chloranilic acid is present in the solution in a concentration of 5 percent by weight based upon the total weight of the solution.

Substantially similar results are achieved.

EXAMPLE IV

Example I is repeated with the exception that the yarn is immersed in a solution of 1,5-naphthalenediol dissolved in acetone. The 1,5-naphthalenediol is present in the solution in a concentration of 10 percent by weight.

Substantially similar results are achieved.

EXAMPLE V

Example I is repeated with the exception that the yarn is immersed in a solution 2,4,6-triaminophenol dissolved in methylethylketone. The 2,4,6-triaminophenol is present in the solution in a concentration of 7.5 percent by weight.

Substantially similar results are achieved.

EXAMPLE VI

Example I is repeated with the exception that the yarn is immersed in a solution of N-phenyl-1-naphthylamine dissolved in methylethylketone. The N-phenyl-1-naphthylamine is present in the solution in a concentration of 10 percent by weight.

Substantially similar results are achieved.

EXAMPLE VII

Example I is repeated with the exception that the yarn is immersed in a solution of p,p'-bisphenol dissolved in dioxane. The p,p'-bisphenol is present in the solution in a concentration of 5 percent by weight.

Substantially similar results are achieved.

EXAMPLE VIII

Example I is repeated with the exception that the yarn is immersed in a solution of 2-mercaptobenzothiozole dissolved in dioxane. The 2-mercaptobenzothiazole is present in the solution in a concentration of 7.5 percent by weight.

Substantially similar results are achieved.

EXAMPLE IX

A rectangular section of biaxially oriented acrylonitrile homopolymer film having a thickness of 2 mils is selected as the starting material. The film is impregnated with tetrachlorohydroquinone by immersion for 10 minutes in a 10 percent by weight methyl alcohol solution of the same provided at room temperature (i.e. 25° C.).

The film is removed from the solution and is dried at a temperature of 90° C in a circulating air oven so that the methyl alcohol solvent adhering to the same is substantially evolved. The resulting impregnated and dried film contains tetrachlorohydroquinone in a concentration of about 6 percent by weight.

The film is next placed for 15 minutes in a circulating air oven provided at 300° C. wherein it is converted to a stabilized form while retaining its original configuration substantially intact. The resulting stabilized film is shiny black, flexible, non-burning when subjected to an ordinary match flame, and contains a bound oxygen content of about 8 percent by weight as determined by the Unterzaucher analysis.

In our commonly assigned U.S. Ser. No. 200,184, filed concurrently herewith and now U.S. Pat. No. 3,923,950, entitled "Production of Stabilized Acrylic Fibers and Films", is disclosed an improved process wherein an organic antioxidant is incorporated in a solution of an acrylic polymer prior to forming a fiber or film from the same which is ultimately heated in an oxygen-containing atmosphere.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An improved process for the stabilization of an acrylic fibrous material or film selected from the group consisting of an acrylonitrile homopolymer and acrylonitrile copolymers containing at least about 85 mol percent of acrylonitrile units and up to about 15 mol percent of one or more monovinyl units copolymerized therewith comprising:

a. impregnating said fibrous material or film with a minor quantity of an organic antioxidant capable of moderating the oxidative cross-linking reaction of adjoining acrylic molecules by contact with a solution of said organic antioxidant in a solvent incapable of dissolving said fibrous material or film having a temperature of about 0° to 100° C. while preserving the original configuration of said fibrous material or film substantially intact, with said organic antioxidant being provided in said solution in a concentration of about 0.2 to 20 percent by weight based upon the total weight of the solution, b. drying said fibrous material or film to substantially remove said solvent therefrom and to form an acrylic fibrous material or film having incorporated therein about 1 to 10 percent by weight based upon the weight of said acrylic polymer of said organic antioxidant, and c. heating said resulting impregnated and dried fibrous material or film in an oxygen-containing atmosphere at a temperature of about 200° to 360° C. until a stabilized fibrous material or film is formed which is black in appearance, retains its original configuration substantially intact and which is non-burning when subjected to an ordinary match flame.

2. An improved process according to claim 1 wherein said acrylic precursor is a fibrous material.

3. An improved process according to claim 1 wherein said acrylic precursor is a film.

4. An improved process according to claim 2 wherein said acrylic fibrous material is an acrylonitrile homopolymer.

5. An improved process according to claim 2 wherein said acrylic fibrous material is an acrylonitrile copolymer containing at least about 95 mol percent of acrylonitrile units and up to about 5 mol percent of one or more monovinyl units copolymerized therewith.

6. An improved process according to claim 1 wherein said organic antioxidant has a melting point of at least 200° C.

7. An improved process according to claim 6 wherein said resulting impregnated and dried acrylic fibrous material or film contains said organic antioxidant in a concentration of about 5 to 10 percent by weight immediately prior to heating in said oxygen-containing atmosphere.

8. An improved process according to claim 1 wherein said oxygen-containing atmosphere is provided at a temperature of about 240°to 360° C.

9. An improved process for the stabilization of an acrylic fibrous material or film selected from the group consisting of an acrylonitrile homopolymer and acrylonitrile copolymers containing at least about 85 mol percent of acrylonitrile units and up to about 15 mol percent of one or more monovinyl units copolymerized therewith comprising:

a. impregnating said fibrous material or film with a minor quantity of an organic antioxidant having a melting point of at least 200° C. capable of moderating the oxidative cross-linking reaction of adjoining acrylic molecules selected from the group consisting of a nitrogen-free phenolic antioxidant, an aminophenol antioxidant, a non-phenolic aromatic amine antioxidant, a quinone antioxidant, a sulfur-containing antioxidant, and mixtures of the foregoing, by contact with a solution of said organic antioxidant in a solvent incapable of dissolving said fibrous material or film having a temperature of about 0° to 100° C. while preserving the original configuration of said fibrous material or film substantially intact, with said organic antioxidant being provided in said solution in a concentration of about 0.2 to 20 percent by weight based upon the total weight of the solution, b. drying said fibrous material or film to substantially remove said solvent therefrom and to form an acrylic fibrous material or film having incorporated therein about 1 to 10 percent by weight based upon the weight of said acrylic polymer of said organic antioxidant, and c. heating said resulting impregnated and dried fibrous material or film in an oxygen-containing atmosphere at a temperature of about 200° to 360° C. until a stabilized fibrous material or film is formed which is black in appearance, retains its original configuration substantially intact and which is non-burning when subjected to an ordinary match flame.

10. An improved process according to claim 9 wherein aid acrylic precursor is a fibrous material.

11. An improved process according to claim 9 wherein said acrylic precursor is a film.

12. An improved process according to claim 10 wherein said acrylic fibrous material is an acrylonitrile homopolymer.

13. An improved process according to claim 10 wherein said acrylic fibrous material is an acrylonitrile copolymer containing at least about 95 mol percent of acrylonitrile units and up to about 5 mol percent of one or more monovinyl units copolymerized therewith.

14. An improved process according to claim 9 wherein said resulting impregnated and dried acrylic fibrous material or film contains said organic antioxidant in a concentration of about 5 to 10 percent by weight immediately prior to heating in said oxygen-containing atmosphere.

15. An improved process according to claim 9 wherein said organic antioxidant is a nitrogen-free phenolic antioxidant.

16. An improved process according to claim 9 wherein said organic antioxidant is an aminophenol antioxidant.

17. An improved process according to claim 9 wherein said organic antioxidant is a non-phenolic aromatic amine antioxidant.

18. An improved process according to claim 9 wherein said organic antioxidant is a quinone antioxidant.

19. An improved process according to claim 9 wherein said organic antioxidant is a sulfur-containing antioxidant.

20. An improved process according to claim 9 wherein said oxygen-containing atmosphere is provided at a temperature of about 240°to 360° C.

21. An improved process for the stabilization of an acrylic fibrous material or film selected from the group consisting of an acrylonitrile homopolymer and acrylonitrile copolymers containing at least about 85 mol percent of acrylonitrile units and up to about 15 mol percent of one or more monovinyl units copolymerized therewith comprising:

a. impregnating said fibrous material or film with a minor quantity of an organic antioxidant selected from the group consisting of tetrachlorohydroquinone, chloranil, chloranilic acid, and mixtures of the foregoing, by contact with a solution of the same in a solvent incapable of dissolving said fibrous material or film having a temperature of about 0° to 100° C. while preserving the original configuration of said fibrous material or film essentially intact, with said organic antioxidant being provided in said solution in a concentration of about 0.2 to 20 percent by weight based upon the total weight of the solution, b. drying said fibrous material or film to substantially remove said solvent therefrom and to form an acrylic fibrous material or film having incorporated therein about 1 to 10 percent by weight based upon the weight of said acrylic polymer of said organic antioxidant, and c. heating said resulting impregnated and dried fibrous material or film in an oxygen-containing atmosphere at a temperature of about 200° to 360° C. until a stabilized fibrous material or film is formed which is black in appearance, retains its original configuration substantially intact and which is non-burning when subjected to an ordinary match flame.

22. An improved process according to claim 21 wherein said acrylic precursor is a fibrous material.

23. An improved process according to claim 21 wherein said acrylic precursor is a film.

24. An improved process according to claim 22 wherein said acrylic fibrous material is an acrylonitrile homopolymer.

25. An improved process according to claim 22 wherein said acrylic fibrous material is an acrylonitrile copolymer containing at least about 95 mol percent of acrylonitrile units and up to about 5 mol percent of one or more monovinyl units copolymerized therewith.

26. An improved process according to claim 21 wherein said resulting impregnated and dried acrylic fibrous material or film contains said organic antioxidant in a concentration of about 5 to 10 percent by weight immediately prior to heating in said oxygen-containing atmosphere.

27. An improved process according to claim 26 wherein said organic antioxidant is tetrachlorohydroquinone.

28. An improved process according to claim 21 wherein said oxygen-containing atmosphere is provided at a temperature of about 240° to 360° C.

* * * * *